United States Patent [19]

Ryder

[11] 4,424,987

[45] Jan. 10, 1984

[54] TELESCOPIC SKI POLE ASSEMBLY

[76] Inventor: Gregory P. Ryder, 5551 Zinman Ave., Altasloma, Calif. 91701

[21] Appl. No.: 306,415

[22] Filed: Sep. 28, 1981

[51] Int. Cl.[3] ..... A63C 11/22

[52] U.S. Cl. ..... 280/823; 403/109

[58] Field of Search ..... 280/819, 820, 823; 403/109, 377; 135/75

[56] References Cited

U.S. PATENT DOCUMENTS 3,722,903 3/1973 Jones ..... 403/109 X 4,114,911 9/1978 Laird et al. ..... 280/819

FOREIGN PATENT DOCUMENTS 105762 7/1924 Switzerland ..... 403/109

*Primary Examiner*—Joseph F. Peters, Jr.

*Attorney, Agent, or Firm*—Boniard I. Brown

[57] ABSTRACT

A telescopic ski pole having at least first and second elongated tubular members, the first elongated tubular member having a diameter greater than the second elongated tubular member. The first elongated tubular member has disposed at one axial extremity thereof a radially inwardly extending flange having a bore disposed therein dimensioned and configured for engagement with the exterior surface of the second elongated tubular member and the second elongated tubular member has one axial extremity thereof having a radially outwardly extending flange having a circumferential surface dimensioned and configured for engagement with the interior bore of the first elongated tubular member. The flange on the first elongated member and the flange on the second elongated tubular member include structure for selective locking engagement between the two flanges to prevent relative axial movement between the first and second elongated tubular members.

10 Claims, 7 Drawing Figures

TELESCOPIC SKI POLE ASSEMBLY

BACKGROUND OF THE INVENTION

The invention relates to sporting goods and particularly to ski poles used in both downhill and alpine skiing. Skiers ordinarily are required to carry relatively bulky ski equipment which may include boots, skis, poles, and other accessories. This equipment is particularly awkward to carry because the elongated members tend to assume divergent directions making the carrying process even more awkward. The awkwardness is further aggravated by the necessity for holding the skis in a manner which will (1) avoid contact between the sharp edges of the skis and relatively expensive ski clothing that would be damaged by these edges and (2) avoid injuring the persons carrying the poles and other persons.

It is an object of the invention to provide a ski pole which can be more easily carried.

It is another object of the invention to provide a ski pole which may be collapsed to a relatively compact form which will be less awkward to carry than conventional ski pole constructions.

Still another object of the invention to provide apparatus which can be manufactured relatively easily.

SUMMARY OF THE INVENTION

The foregoing objects and other objects and advantages which shall become apparent from the detailed description of the preferred embodiment are attained in a collapsible or telescopic ski pole apparatus having at least first and second elongated tubular members, the first elongated tubular member having a diameter greater than the second elongated tubular member. The second elongated tubular member has disposed at one axial extremity thereof a radially inwardly extending flange having a bore disposed therein dimensioned and configured for engagement with the exterior surface of the elongated tubular member and the second elongated tubular member having one axial extremity thereof has a radially outwardly extending flange having a circumferential surface dimensioned and configured for engagement with the interior bore of the first elongated tubular member. The flange on the first elongated tubular member and the flange on the second elongated tubular member include structure for selective locking engagement between the two flanges to prevent relative axial movement between the first and second elongated tubular members.

The means for selective locking engagement may include at least two slots in one of the flanges and at least two pins disposed in the other of the flanges. The pins are dimensioned and configured for engagement with the slots. The slots are arcuate, as viewed from the axial extremity of the elongated tubular member, in which they are disposed. The slots may have a center of curvature which may be coincident with the geometric axis of the elongated tubular member of which they may be a part. The pins may be axially biased. The pins may be axially biased in a direction which is away from the slots and each slot may have a portion thereof having a width which is greater than the remainder thereof. This portion will permit extrance of one of the pins in embodiments in which it is included. The pins may be each biased by a coil spring. The apparatus may include indicia disposed on the outer faces of the first and second elongated tubular members indicating the locked and unlocked positions thereof. The apparatus may further include a third elongated tubular member and the second and third elongated tubular members each may have an axial extremity which may be substantially the same as the cooperating axial extremities of the first and second elongated tubular members.

BRIEF DESCRIPTION OF THE ACCOMPANYING DRAWING

DESCRIPTION OF THE PREFERRED EMBODIMENT

Figure 1:
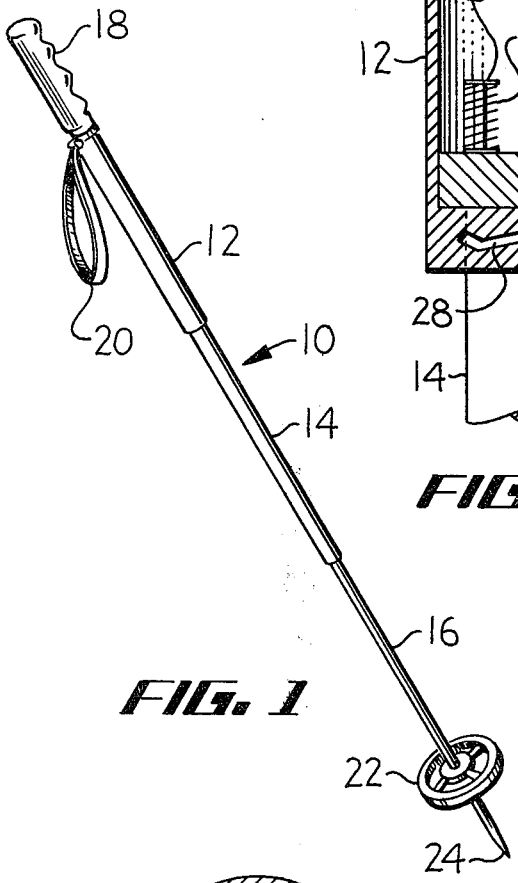
FIG. 1 is a perspective view of a telescopic ski pole apparatus in accordance with the invention in which the telescopic sections thereof are disposed in extended relationship.

Referring now to FIGS. 1–7 there is shown a ski pole 10 in accordance with the invention. The ski pole includes first, second and third axial members which are respectively identified by the numerals 12, 14 and 16. The first axial section 12 is provided with a handle 18 and a wrist loop 20. The third axial section 16 is provided with a basket 22 and a point 24. The axial sections 12, 14 and 16 are of telescopic construction to facilitate the easy transport of the ski pole.

Figure 2:
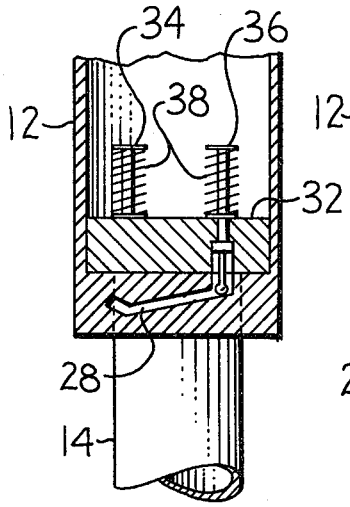
FIG. 2 is a partial sectional view illustrating one geometric relationship between the mating pins and slots of adjacent elongated tubular sections within the ski pole illustrated in FIG. 1.
Figure 3:
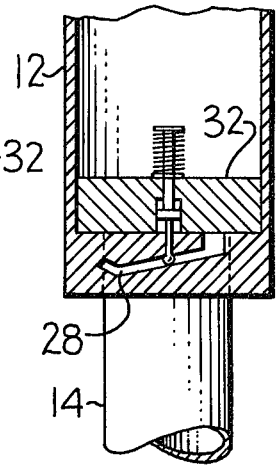
FIGS. 3 and 4 are views similar to FIG. 2 and illustrating successive positions of the same elongated tubular sections upon relative rotation.
Figure 4:
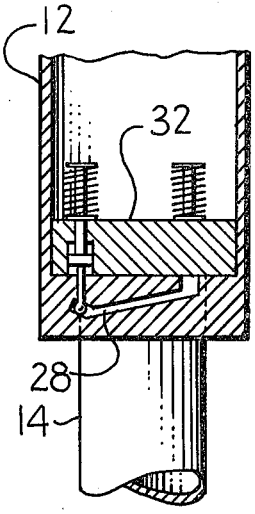
Figure 5:
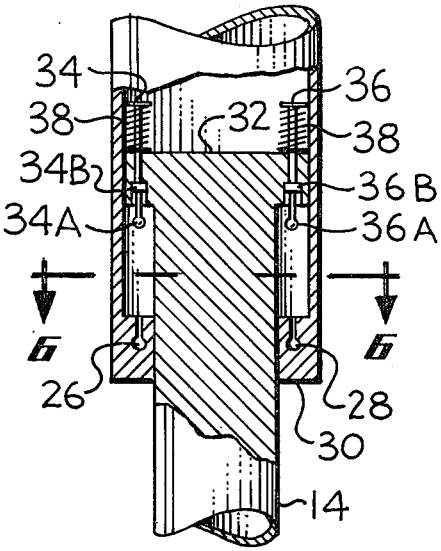
FIG. 5 is another view in partial cross-section similar to FIGS. 2, 3 and 4 which further illustrates the relationship between the cooperating pins and slots when not engaged.
Figure 6:
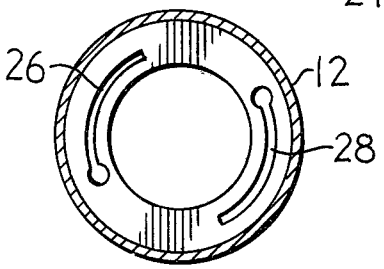
FIG. 6 is a cross-sectional view taken along the line 6—6 of FIG. 5.

As best shown in FIGS. 2–6, the first axial section 12 is provided with slots 26, 28. As best shown in FIG. 6, the slots 26, 28 have an axial extremity which is of larger size than the remainder thereof. As best shown in FIGS. 2–4, the slots 26, 28 (only illustrated) extend downwardly as viewed and have an L-shape extremity. The slots 26, 28 are disposed in a radially inwardly extending flange 30 which has an internal bore which cooperates with the exterior surface of the second axial section 14, as best seen in FIG. 5.

Referring now particularly to FIGS. 2–5, there is shown the contruction of the second axial section 14. The second axial section 14 includes a radially outwardly extending flange 32 in which are carried first and second elongated pins 34, 36. Each of the pins 34, 36 is provided with a bulbous head. These heads are identified by the numerals 34A and 36A. Each of the pins 34, 36 is further provided with a shoulder, respectively identified by the numerals 34B and 36B. Each pin 34, 36 is dimensioned for sliding axial movement with respect to a bore in the flange 32. Coil springs 38, 38 cooperate with the axial extremity of each pin 34, 36 to bias it in a direction which is away from the cooperating slot 26 or 28.

As best seen in FIGS. 2, 3 and 4, initially moving the first and second axial sections 12, 14 to the maximum extended position results in the entrance of the head or bulbous end 36A of the pin 36 into the enlarged extremity of the slot 28. Initial relative angular motion between the first and second axial sections 12, 14 results in the relative position of the parts illustrated in FIG. 3. Further relative angular rotation between the first and second axial sections 12, 14 results in the relative position of the elements wherein the bulbous end 36A of the pin 36 passes further along the extent of the slot 28 and past the bend therein to the other axial extremity. In a similar manner, the other pin 34 and the bulbous end thereof 34A and the slot cooperate to firmly lock the first and second axial sections 12, 14 in one relative axial position thereof.

Figure 7:
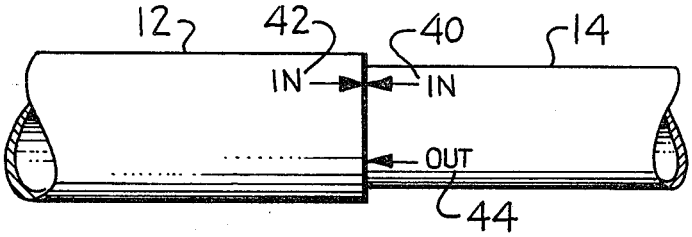
FIG. 7 is a view illustrating an axial portion of the apparatus illustrated in FIG. 1 and illustrating the indicia thereon.

As best illustrated in FIG. 7, the first and second axial sections are provided with indicia 40, 42 and 44 which indicate the relative angular position of the first and second axial sections 12, 14 and thus enable the user to determine the relative positions of the pins 34, 36 and the slots 26, 28.

In a similar manner the lower axial extremity of the second axial section 14 and the upper axial extremity of the third axial section 16 are provided with flanges and other cooperating structures as illustrated in FIGS. 2–6.

In various embodiments of the invention the slot and pin structure illustrated may be modified to provide other means for locking axially adjacent elongated tubular sections. Similarly, even in the specific structure which has been illustrated, the position of the slots and pins may be reversed without departing from the spirit of the invention.

The invention has been described with reference to its illustrated preferred embodiment. Persons skilled in the art of constructing various mechanical devices may, upon exposure to the teachings herein, conceive variations in the mechanical development of the components therein. Such variations are deemed to be encompassed by the disclosure, the invention being delimited only by the appended claims.

The inventor claims:

1. A telescopic ski pole having at least first and second elongated tubular members, said first elongated tubular member having a diameter greater than said second elongated tubular member, said first elongated tubular member having at one axial extremity thereof a radially inwardly extending flange defining a bore therein dimensioned and configured for engagement with the exterior surface of said second elongated tubular member, said second elongated tubular member having at one axial extremity thereof a radially outwardly extending flange having a circumferential surface dimensioned and configured for engagement with the interior bore of said first elongated tubular member, pin means carried on one of said flanges, and slot means defined in the other of said flanges and configurated and sized for engagement with the pin means, the pin means being selectively engageable in the slot means for locking engagement between the flanges to prevent relative axial movement between the first and second tubular members.

2. The apparatus as described in claim 1, wherein:

said slot means comprises at least two slots in one of said flanges and said pin means comprises at least two pins disposed in the other of said flanges, said pins being dimensioned and configured for engagement with said slots.

3. The apparatus as described in claim 2, wherein:

said slots are arcuate as viewed from the axial extremity of the elongated tubular member in which they are disposed.

4. The apparatus as described in claim 3, wherein:

said slots have a center of curvature coincident with the geometric axis of the elongated tubular member in which they are disposed.

5. The apparatus as described in claim 4, wherein:

said pins are axially biased.

6. The apparatus as described in claim 5, wherein:

said pins are axially biased in a direction away from said slots.

7. The apparatus as described in claim 6, wherein:

said slot has a portion having a width which is greater than the remainder thereof, said portion permitting extrance of one of said pins.

8. The apparatus as described in claim 7, wherein:

said pins are each biased by a coil spring.

9. The apparatus as described in claim 8, wherein:

said apparatus includes indicia disposed on the outer faces of said first and second elongated tubular members indicating the locked and unlocked positions thereof.

10. The apparatus as described in claims 1, 2, 3, 4, 5, 6, 7, 8, or 9, wherein:

said apparatus further includes a third elongated tubular member and said second and third elongated tubular members each have an axial extremity which is substantially the same as the cooperating axial extremities of said first and second elongated tubular members.

* * * * *